US006409579B1

(12) United States Patent
White, II et al.

(10) Patent No.: US 6,409,579 B1
(45) Date of Patent: Jun. 25, 2002

(54) METHOD AND APPARATUS FOR CONDITIONING A POLISH PAD AT THE POINT OF POLISH AND FOR DISPENSING SLURRY AT THE POINT OF POLISH

(75) Inventors: Nelson W. White, II, Blanco; Albert H. Liu, San Antonio, both of TX (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/586,551

(22) Filed: May 31, 2000

(51) Int. Cl.[7] ..... B24B 1/00

(52) U.S. Cl. ..... 451/56; 451/41; 451/285; 451/910

(58) Field of Search ..... 451/41, 56, 60, 451/63, 72, 91, 285, 287, 443, 444, 910

(56) References Cited

U.S. PATENT DOCUMENTS 5,547,417 A * 8/1996 Breivogel et al. ..... 451/56
5,782,675 A * 7/1998 Southwick ..... 451/56
5,803,799 A * 9/1998 Volodarsky et al. .... 451/287 X
5,931,725 A 8/1999 Inaba et al. ..... 451/288
6,007,411 A * 12/1999 Feeney ..... 451/287 X
6,022,265 A * 2/2000 Drill et al. ..... 451/56
6,030,487 A 2/2000 Fisher, Jr. et al. ..... 156/345
6,033,290 A 3/2000 Gurusamy et al. ..... 451/56
6,139,428 A * 10/2000 Drill et al. ..... 451/56 X
6,162,112 A * 12/2000 Miyazaki et al. ..... 451/56 X

* cited by examiner

*Primary Examiner*—Joseph J. Hail, III
*Assistant Examiner*—Anthony Ojini
(74) *Attorney, Agent, or Firm*—Peter Zawilski

(57) ABSTRACT

A method of conditioning a polish pad at the point of polish and for dispensing slurry at the point of polish. In one embodiment, the method comprises several steps. In the first step, polishing slurry is received at a CMP machine. Next, a polish pad is rotated. Then, the polishing slurry is dispensed onto a portion of said polish pad located proximately around a location designated for holding a wafer.

22 Claims, 12 Drawing Sheets

METHOD AND APPARATUS FOR CONDITIONING A POLISH PAD AT THE POINT OF POLISH AND FOR DISPENSING SLURRY AT THE POINT OF POLISH

TECHNICAL FIELD

The field of the present invention pertains to processes and apparatus related to chemical mechanical polishing operations for fabricating semiconductors and integrated circuits. More particularly, the present invention relates to the field of dispensing slurry on a polish pad and for conditioning a polish pad for chemical mechanical polishing operations.

BACKGROUND ART

Conventional integrated circuits (IC) are fashioned from miniature electrical devices such as resistors, diodes, and transistors. These miniature electrical devices are created by using deposition operations to create layers of material, by using photolithography to create patterns in the wafer, and by using chemical mechanical polishing (CMP) operations to polish away unwanted portions of the layers of material. In order to provide consistent and even layers, a need arises for a method and apparatus that can polish a wafer surface to be very flat.

CMP is the preferred method for planarizing a semiconductor wafer. In particular, CMP flattens out height differences between high spots and low spots on the wafer. This is accomplished via mechanical contact between the wafer and a moving polish pad that is saturated with an abrasive polish slurry. Polishing in this manner is the only technique that provides a smooth topography when examined on a millimeter scale. That is, the wafer is essentially flat when measured over the distance of a millimeter.

Prior art FIG. 1A is a plan view of a chemical mechanical polishing (CMP) machine 100. Prior art FIG. 1B is an elevation view of CMP machine 100. CMP machine 100 picks up a wafer to be polished with a carrier arm 101 and holds it against a rotating polish pad 102. Polish pad 102 is made of a resilient material and is textured, often with multiple predetermined grooves 103, to aid the polishing process. Polish pad 102 rotates on a platen, or turntable, 104 located beneath polish pad 102, at a predetermined speed. A wafer 105 is held in place on polish pad 102 within a carrier ring 112 that is connected to a carrier 106 of carrier arm 101. The front surface of wafer 105 rests against polish pad 102. The back surface of wafer 105 is held against a surface of carrier 106 of carrier arm 101. As polish pad 102 rotates in one direction 114, e.g. a clockwise direction 114, carrier 106 itself rotates wafer 105 at a predetermined rate. CMP machine 100 also includes a slurry dispense arm 107 extending across the radius of polish pad 102. Slurry dispense arm 107 dispenses a flow of polish slurry onto polish pad 102 via port 132. To improve dispersal of polish slurry over polish pad 102, slurry dispense arm 107 disperses polish slurry while it traverses across the radius of polish pad 102 in direction 134.

To aid in maintaining a stable removal rate, CMP machine 100 includes a conditioner assembly 120. Conditioner assembly 120 includes a conditioner arm 108, which extends across the radius of polish pad 102. An end effector 109 is connected to conditioner arm 108. End effector 109 includes an abrasive conditioning disk 110 that is used to roughen the surface of polish pad 102. Conditioning disk 110 is rotated by conditioner arm 108 in the same direction as pad 102, e.g. in a clockwise direction 130, and is transitionally moved across the radius of polish pad 102 in direction 138, such that conditioning disk 110 covers the radius of polish pad 102. In so doing, conditioning disk 110 covers the surface area of polish pad 102, as polish pad 102 rotates. The pad is conditioned by conditioning assembly 120 to help keep the pad profile as flat as possible. However, there is no guarantee that conditioner assembly 120 actually conditions the polish pad 102 precisely where the wafer contacted the polish pad. If there is a mismatch between the polishing operation, where wafer 105 contacted polish pad 102, and the conditioning operation, where conditioning disk 110 contacts polish pad 102, then the pad profile may become skewed. Similarly, if conditioning assembly 120 is biased to a region, it may result in uneven polishing because of the uneven conditioning of polish pad 102. Furthermore, conditioning assembly 120 can be a source of defect particles. Consequently, a need arises for a method of conditioning a pad that will ensure a consistent and flat pad profile.

A polish pad with a roughened surface has an increased number of micro-pits and gouges in its surface that produces a faster removal rate of material from wafer 105 via increased slurry transfer to the surface of wafer 105. The surface texture of the polish pad is created from conditioner assembly 120, which is typically coated with diamonds. Without conditioning, the surface of polish pad 102 is smoothed during the polishing process and removal rate decreases dramatically. Conditioner assembly 120 re-roughens the surface of polish pad 102, thereby keeping the grooves cleaned out, improving the transport of slurry, and improving the removal rate of material from the wafer.

As described above, the CMP process uses abrasive slurry on a polish pad. The polishing action of the slurry is comprised of an abrasive frictional component and a chemical component. The abrasive frictional component is due to the friction between the surface of the polish pad, the surface of the wafer, and the abrasive particles suspended in the slurry. The chemical component is due to the presence in the slurry of polishing agents that chemically interact with the material of the dielectric layer of wafer 105. The chemical component of the slurry is used to soften the surface of the dielectric layer to be polished, while the frictional component removes material from the surface of wafer 105.

As shown by prior art FIGS. 1A and 1B, the conventional method of dispensing slurry onto the polish pad uses a separate dedicated device, e.g. slurry dispense arm 107, that has a control mechanism for moving across the pad to deliver polish slurry across the entire radius of polish pad 102. This conventional method and apparatus proliferates the control mechanisms, and the complexity of the CMP machine. Consequently, a need arises for an apparatus and method of reducing the complexity of a slurry dispense mechanism for the polishing operation.

Conventional controls attempt to align slurry dispense arm 107 with the anticipated location of the wafer being polished. However, there is no guarantee that slurry dispense arm 107 will provide slurry material precisely where the wafer will contacted the polish pad. If there is a mismatch between the location of the slurry deposited on polish pad 102, and the location of the wafer contacting polish pad 102, nearly 270° later, then the pad profile and the polishing rate across wafer 105 may become uneven. Consequently, a collateral need arises in the CMP operation is to improve the uniformity of polish slurry dispensing.

Similarly, as shown by prior art FIGS. 1A and 1B, the conventional method of conditioning the polish pad uses a separate dedicated device, e.g. conditioner assembly 120, that has a control mechanism for circular motion and for rotational motion across the polish pad. This conventional method and apparatus proliferates the control mechanisms and the size of a CMP machine. Consequently, a need arises for an apparatus and method of reducing the complexity of a conditioning mechanism for the polishing operation. A collateral need in the CMP operation is to improve the efficiency of pad conditioning.

In summary, a need arises for a method and apparatus that can create a very flat surface on the wafer. More specifically, a need arises for an apparatus and method of reducing the complexity of a slurry dispense mechanism for a CMP polishing operation. A collateral need arises in the CMP operation to improve the uniformity of polish slurry dispensing. Yet another need arises for an apparatus and method of reducing the complexity of a conditioning mechanism for the polishing operation. A collateral need arises in the CMP operation is to improve the efficiency of pad conditioning.

DISCLOSURE OF THE INVENTION

The present invention provides a method and apparatus of point of polish slurry dispensing. The present invention also improves the uniformity of polish slurry dispensing Hence, the present invention is able to create a very flat surface on a wafer being polished. Furthermore, the present invention provides an apparatus and method with reduced complexity for dispensing polish slurry for a CMP polishing operation.

The present invention also provides a method and apparatus of point of polish conditioning. The present invention also provides a method of conditioning a pad that will ensure a flat pad profile. Additionally the present invention provides an apparatus and method with reduced complexity for conditioning in a polishing operation. Additionally, the present invention provides more efficient pad conditioning.

One embodiment of the present invention provides a chemical mechanical polishing (CMP) machine for performing a CMP operation on a wafer. The CMP machine includes a polish pad, a carrier arm, and a carrier ring. The carrier ring, which is coupled to the carrier arm, has a slurry dispensing port on a bottom face of the carrier ring, which is adapted to interface with the top surface of the polish pad. By incorporating the slurry dispensing function into the carrier ring, the present invention takes advantage of the existing translational motion of the carrier ring across the polish pad. Furthermore, point of polish pad slurry dispensing ensures that slurry is dispensed in locations where the wafer will contact with the pad because the dispensing mechanism is proximately located around the wafer itself. Thus, the present invention eliminates the possibility of polishing a wafer on a portion of the pad that inadequate slurry. This helps ensure an even polishing and improved wafer flatness.

Similarly, the carrier ring has a conditioning device on a bottom face of the carrier ring. By incorporating the conditioning device function into the carrier ring, the present invention takes advantage of the existing rotational motion and translational motion of the carrier ring. Consequently, the present invention eliminates the requirement for a separate conditioning device that has both rotational motion and translational motion. Thus the present invention provides a CMP machine with a conditioning device and a slurry dispensing at the point of polish without the added complexity and other limitations associated with the conventional CMP operation. This embodiment is referred to as point of polish pad slurry dispensing and point of polish pad conditioning because the operations occur proximate to the actual wafer being polished.

Another embodiment of the present invention provides a flowchart implementation of the improved CMP process. In the first step, polish slurry is received at the CMP machine. In a second step, the polish pad is rotated. Next, polish slurry is dispensed proximately around the wafer being polished. That is, the polish slurry is dispensed through the carrier ring that holds the wafer. Thus, the polish slurry is provided at the spatial point of polish of the wafer. In a subsequent step, the polish pad is conditioned proximately around the wafer being polished. The conditioning pins and the dispensing ports are interspersed around a carrier ring to provide consistent and efficient slurry dispensing and conditioning of the polish pad. This eliminates the prior art's mismatch of locations at which the slurry is dispensed, the pad is conditioned, and the wafer is polished.

With an even dispensing of polish slurry around the carrier ring, the polish slurry that is discharged upstream of the wafer provides the polish medium to the wafer. In contrast, the polish slurry that is discharged downstream of the wafer acts as a medium to remove waste from the polishing of the wafer. That is, the polish slurry dispensed downstream of the wafer transports the polishing waste, occurring immediately upstream via the centrifugal force of the spinning polish pad. This process is continued until the degree of desired polishing is accomplished. This method is referred to as a point of polish pad dispensing and conditioning because the dispensing and the polishing occur at the proximate to the actual wafer being polished.

These and other advantages of the present invention will no doubt become obvious to those of ordinary skill in the art after having read the following detailed description of the preferred embodiments which are illustrated in the drawing figures.

BRIEF DESCRIPTION OF THE DRAWINGS

The accompanying drawings, which are incorporated in, and form a part of, this specification, illustrate embodiments of the invention and, together with the description, serve to explain the principles of the invention. The drawings referred to in this description should be understood as not being drawn to scale except if specifically noted.

PRIOR ART

PRIOR ART

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be apparent to one of ordinary skill in the art that the present invention may be practiced without these specific details. In other instances, well-known methods, procedures, components, and circuits have not been described in detail so as not to unnecessarily obscure aspects of the present invention.

Figure 1A:
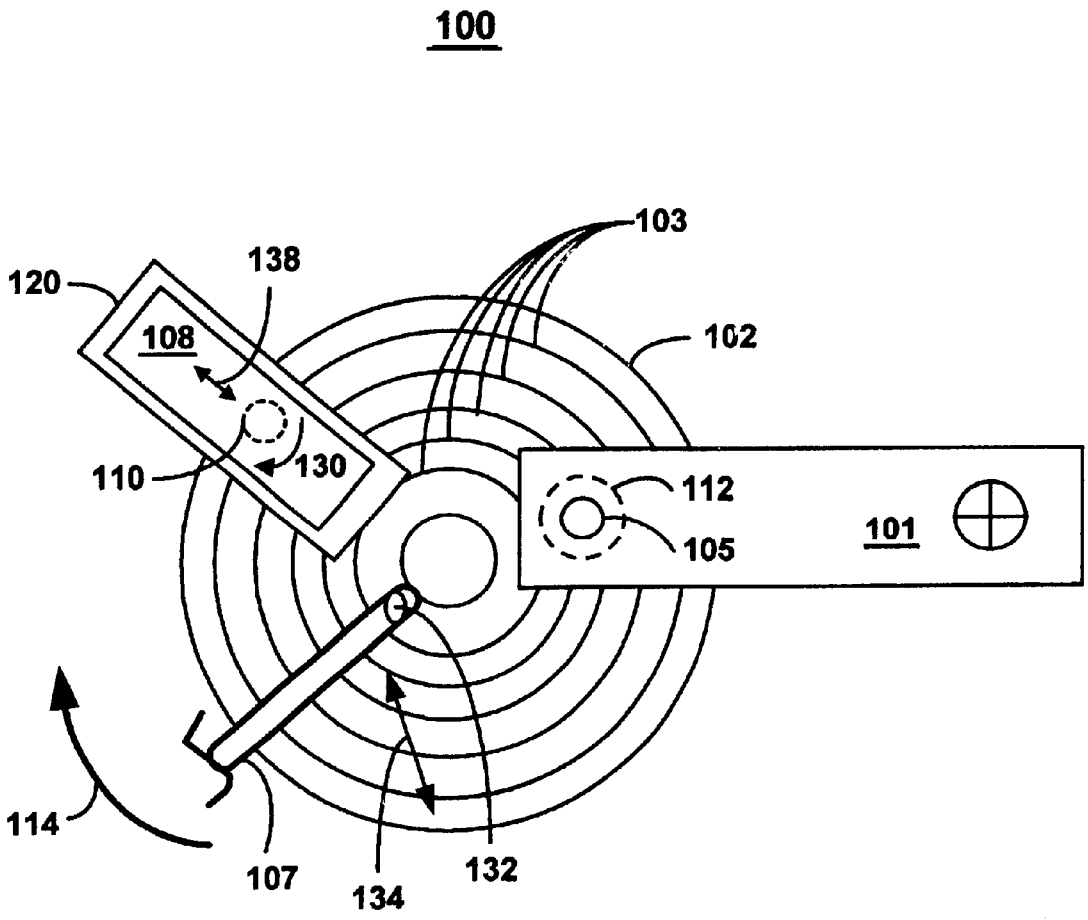
FIG. 1A (Prior Art)
FIG. 1A is a conventional Chemical Mechanical Polish (CMP) machine, shown in a plan view, having a separate slurry dispensing mechanism and a separate conditioning mechanism.
Figure 1B:
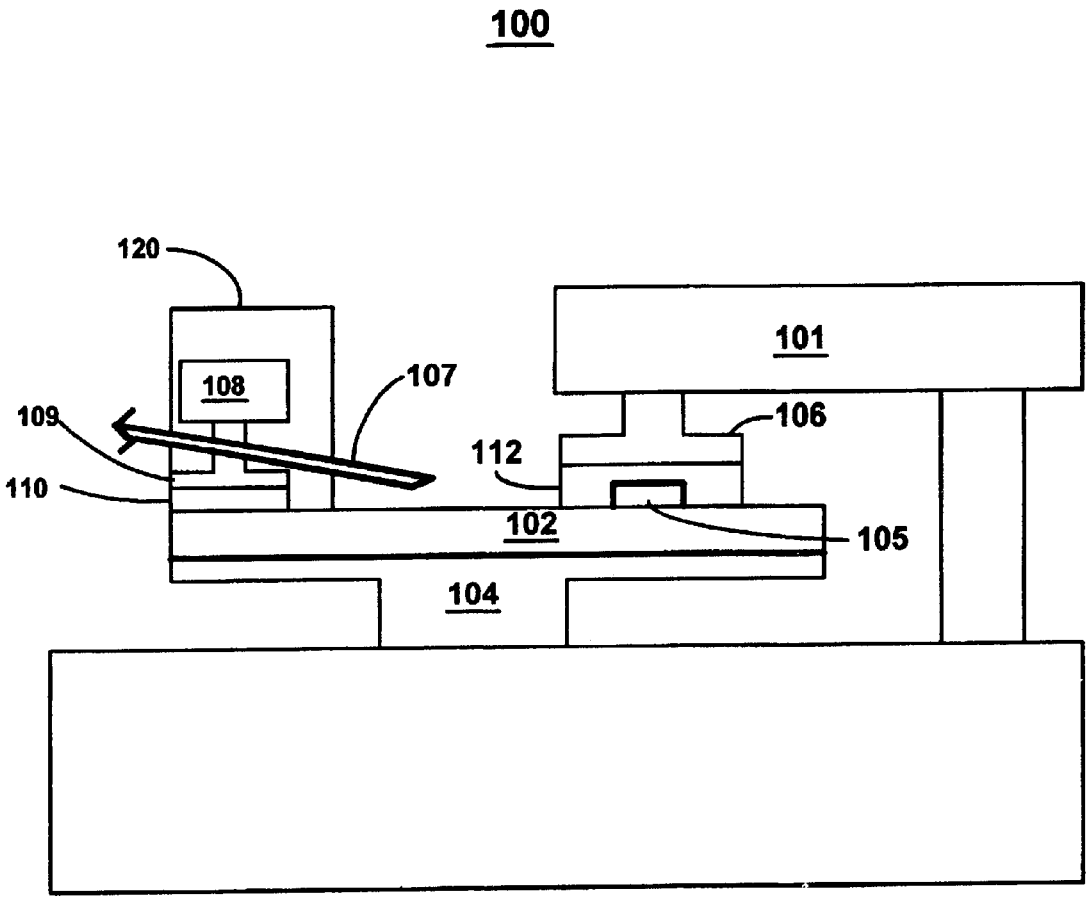
FIG. 1B (Prior Art)
FIG. 1B is a conventional Chemical Mechanical Polish (CMP) machine, shown in an elevation view, having a separate slurry dispensing mechanism and a separate conditioning mechanism.
Figure 2A:
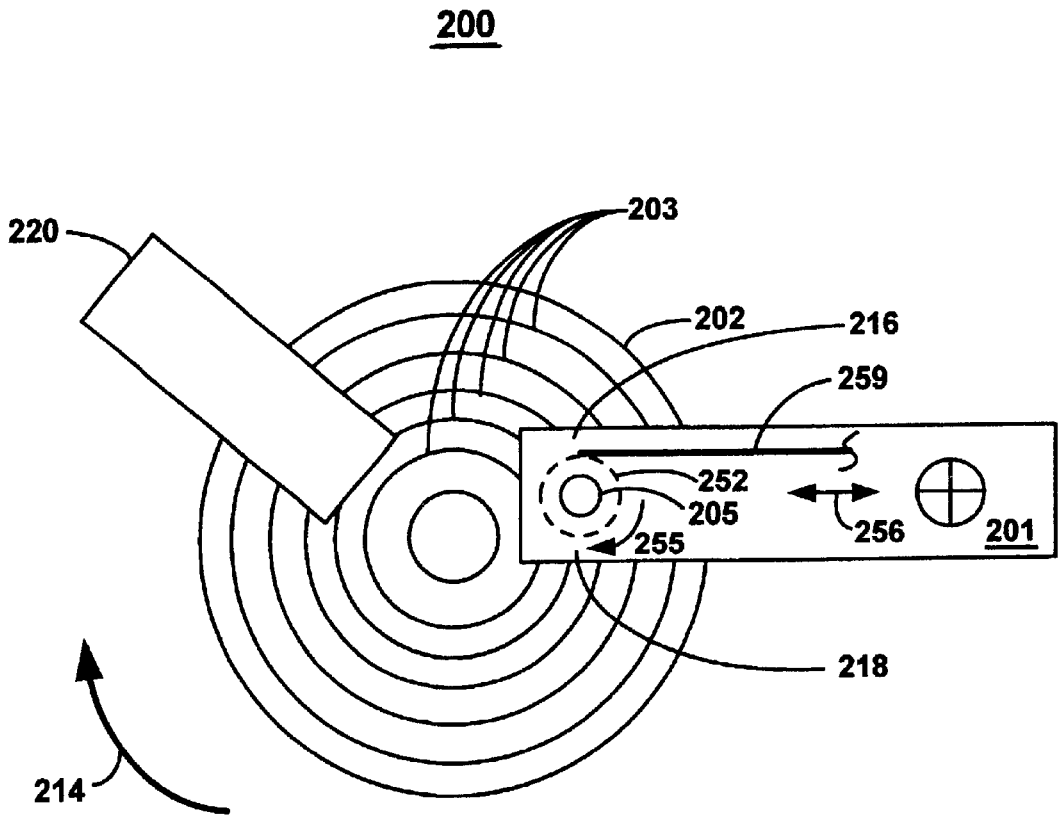
FIG. 2A is a Chemical Mechanical Polish (CMP) machine, shown in a plan view, with point of polish slurry dispensing features, in accordance with one embodiment of the present invention.
Figure 2B:
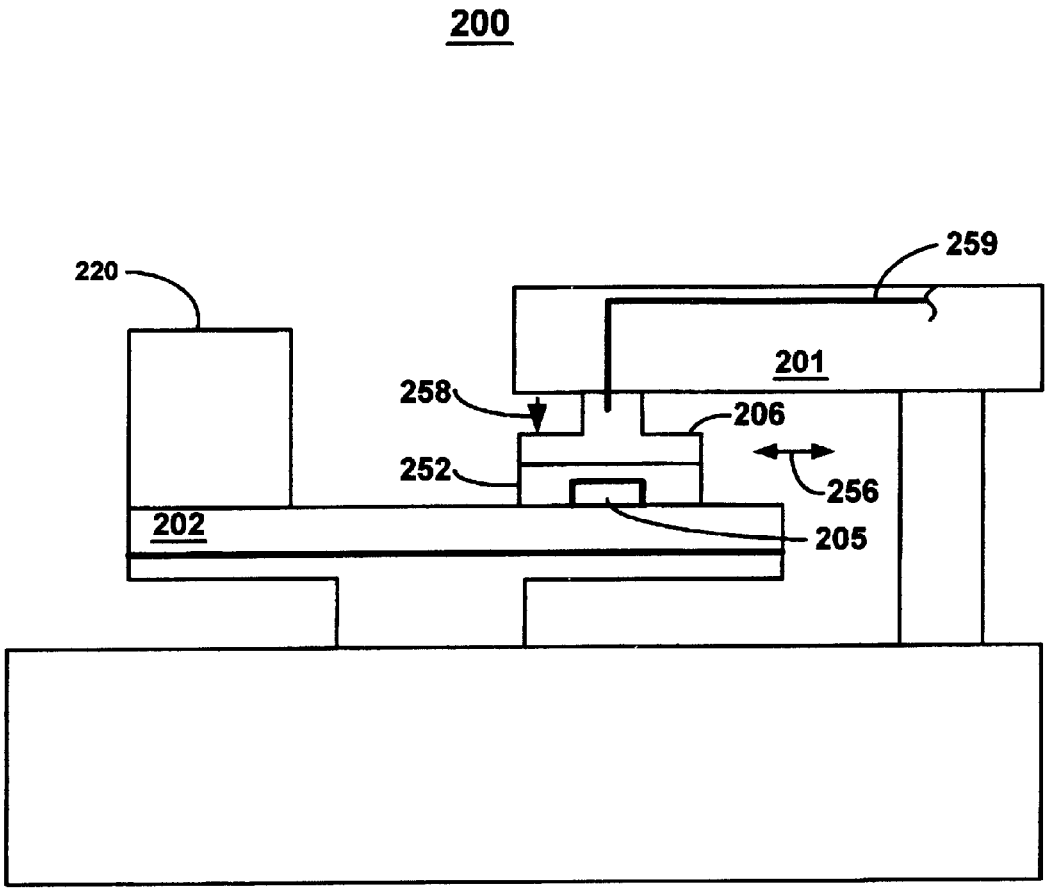
FIG. 2B is a Chemical Mechanical Polish (CMP) machine, shown in an elevation view, with point of polish slurry dispensing features, in accordance with one embodiment of the present invention.

Referring now to FIG. 2A and FIG. 2B, a Chemical Mechanical Polish (CMP) machine 200 with a point of polish slurry dispensing features is shown in a plan view and elevation view, respectively, in accordance with one embodiment of the present invention. CMP machine 200 includes a polish pad 202, a carrier arm 201, a carrier ring 252, and a conditioning assembly 220. Carrier ring 252, which is coupled to carrier arm 201 via carrier 206, is also coupled to a polish slurry supply line 259, in one embodiment. Carrier ring 252 has a dispensing port formed therein for dispensing the polish slurry, shown in detail in a subsequent figure, in one embodiment. CMP machine 200 of the present invention is noticeably simpler and more efficient with the absence of a separate slurry dispense arm, used in the conventional CMP machine shown in prior art FIGS. 1A and 1B. FIG. 2A shows the top surface of polish pad 202.

Carrier ring 252 is subject to rotational motion 255 and to translational motion 256, as implemented by carrier 206 and/or carrier arm 201, in one embodiment. However, the present invention is well-suited to using a variety of mechanisms to provide the rotational and/or translational motion for dispensing polish slurry to the polish pad 202. By piggybacking the slurry dispensing features on existing mechanisms for rotational and translational motion, the present invention provides a more efficient and streamlined CMP machine. This embodiment is referred to as point of polish dispensing because the dispensing occurs proximate to the location where a wafer is actually being polished.

While the present embodiment of FIGS. 2A and 2B utilize carrier ring 252 for dispensing polishing slurry, the present invention is well-suited to using alternative apparatus for dispensing the polishing slurry. For example, one or more add-on slurry dispensing hoses, may be arranged around the outer diameter of a conventional carrier ring. The hoses can have either translational, rotational, or both types of motion, as supplied by a carrier arm 201 or carrier 206, or other mechanism. This latter embodiment would implement point of polish slurry dispensing while only requiring minimal modifications to a conventional carrier ring. Alternatively, the hoses can have neither translational or rotational motion, yet still be proximately located around the path taken by carrier ring 252, thus providing point of polish dispensing.

Figure 2C:
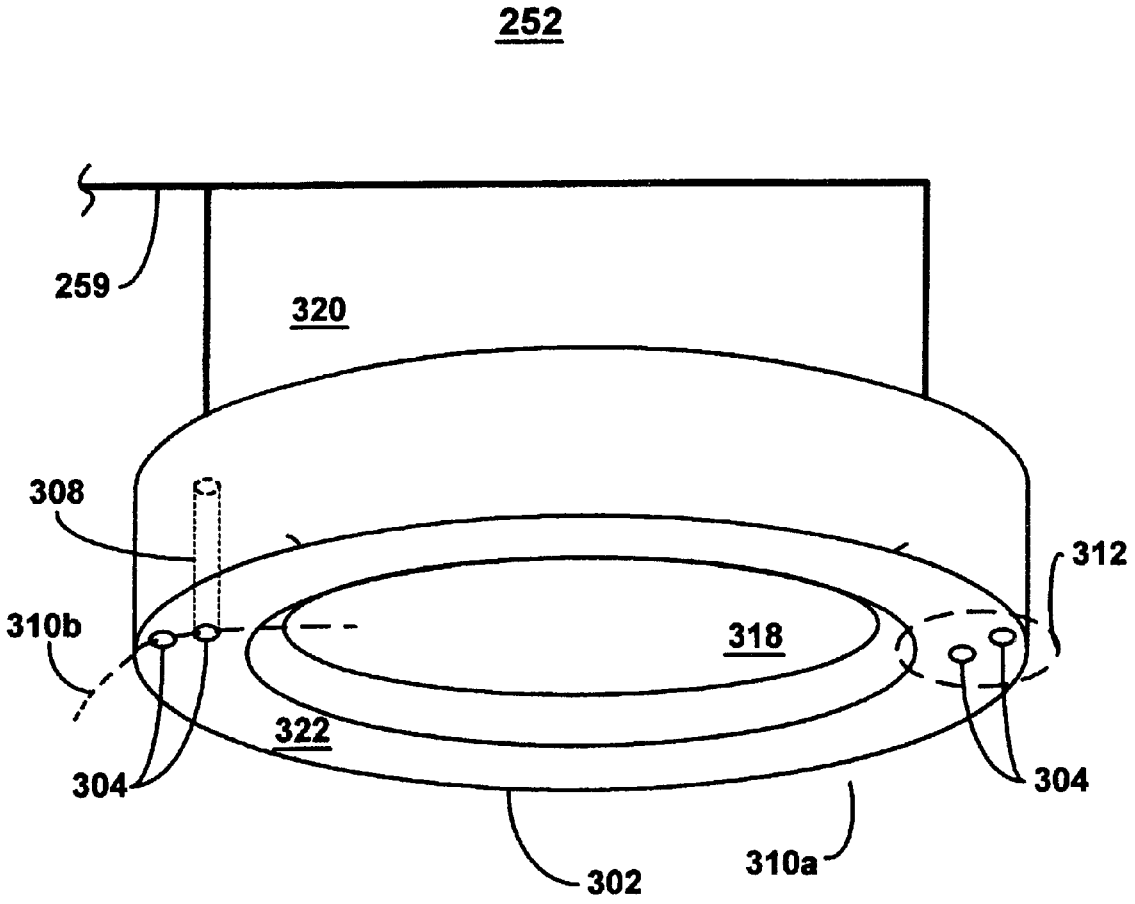
FIG. 2C is a carrier ring, with point of polish slurry dispensing features for use in a CMP machine, in accordance with one embodiment of the present invention.

Referring now to FIG. 2C, a carrier ring 252 having a point of polish slurry dispensing feature, for use in a CMP machine, is shown in accordance with one embodiment of the present invention. Carrier ring 252 has a bottom surface 322 that is placed against polish pad 202 during a CMP operation. Carrier ring 252 includes slurry dispensing ports 304.

While the present embodiment shows a total of four (4) slurry dispensing ports 304, grouped in pairs 312 along a helical, or spiral, path 310*b*, the present invention is well-suited to using any quantity of slurry dispensing ports, grouped in any quantity, and arranged in any pattern. For example, in another embodiment, eight (8) groups of two (2) slurry dispensing ports are used on a carrier ring, arranged on a radial path and evenly spaced around the circumference of the carrier ring.

In the present embodiment, slurry dispensing ports 304 are machined into the parent block of material used to fabricate carrier ring 252, as shown by dashed lines 308 for one of slurry dispensing ports 304. In lieu of integrating slurry dispensing ports 304 into carrier ring 252, the present invention is well-suited to using a wide variety of devices and configurations for providing point of polish slurry dispensing through carrier ring 252.

Polish slurry dispensing line 259 can be coupled to slurry dispensing ports 304 in a wide variety of manners. In one embodiment, a manifold within carrier ring 252 can link all polish slurry dispensing ports 304. Polish slurry can be contained within the rotating carrier head by use of a seal. Alternatively, carrier ring 252 can have two different ring portions in one embodiment. One ring portion, with conditioning pins, can rotate, and the other ring portion, with polish slurry dispensing ports, can remain stationary. This latter embodiment provides a more streamlined construction and operation for the two different functions desired.

Adapter 318 within carrier ring 252 is a cavity designed to hold a wafer for a polishing operation in a CMP machine. Hence, it is apparent how the surrounding polish slurry dispensing ports 304 provide point of polish support in this embodiment. The present invention is well-suited to having any type of adapter or mechanism to retain a wafer for a CMP operation.

Figure 3A:
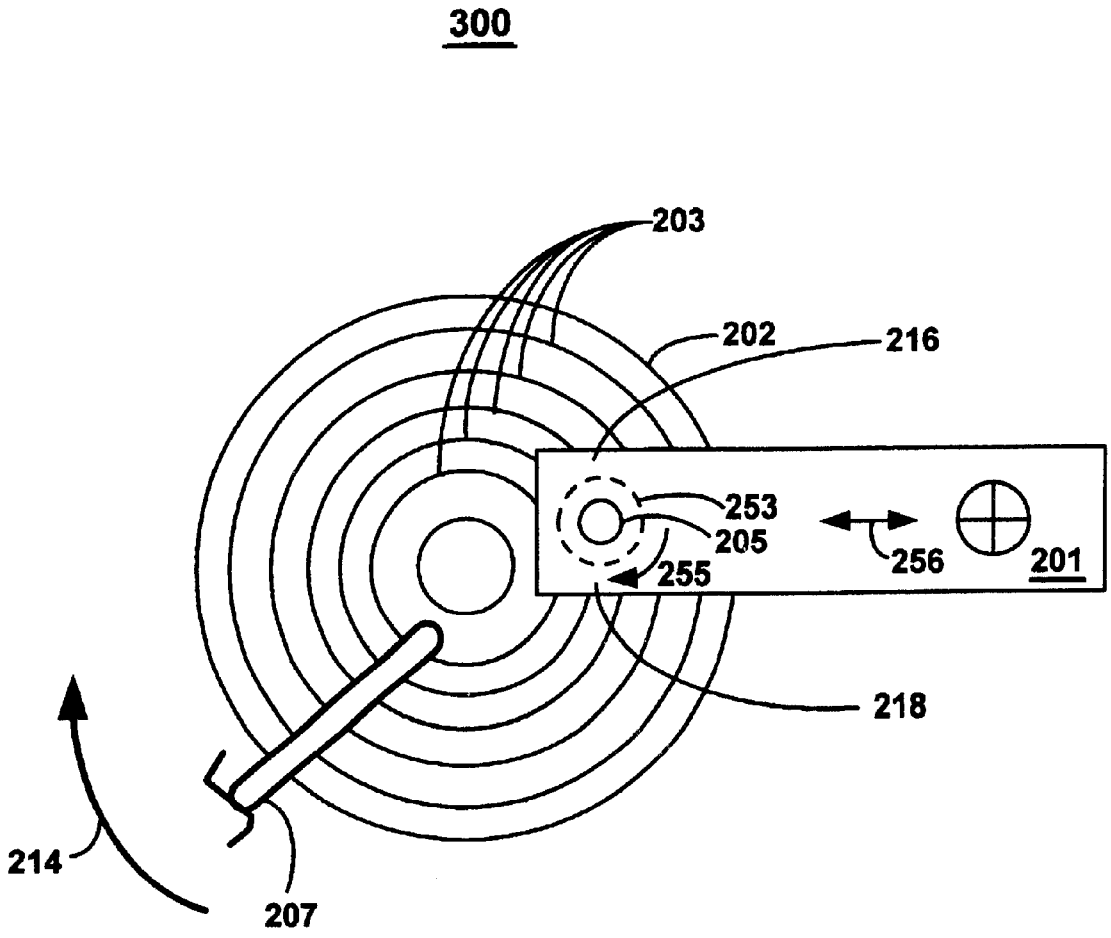
FIG. 3A is a Chemical Mechanical Polish (CMP) machine, shown in a plan view, with point of polish conditioning features, in accordance with one embodiment of the present invention.
Figure 3B:
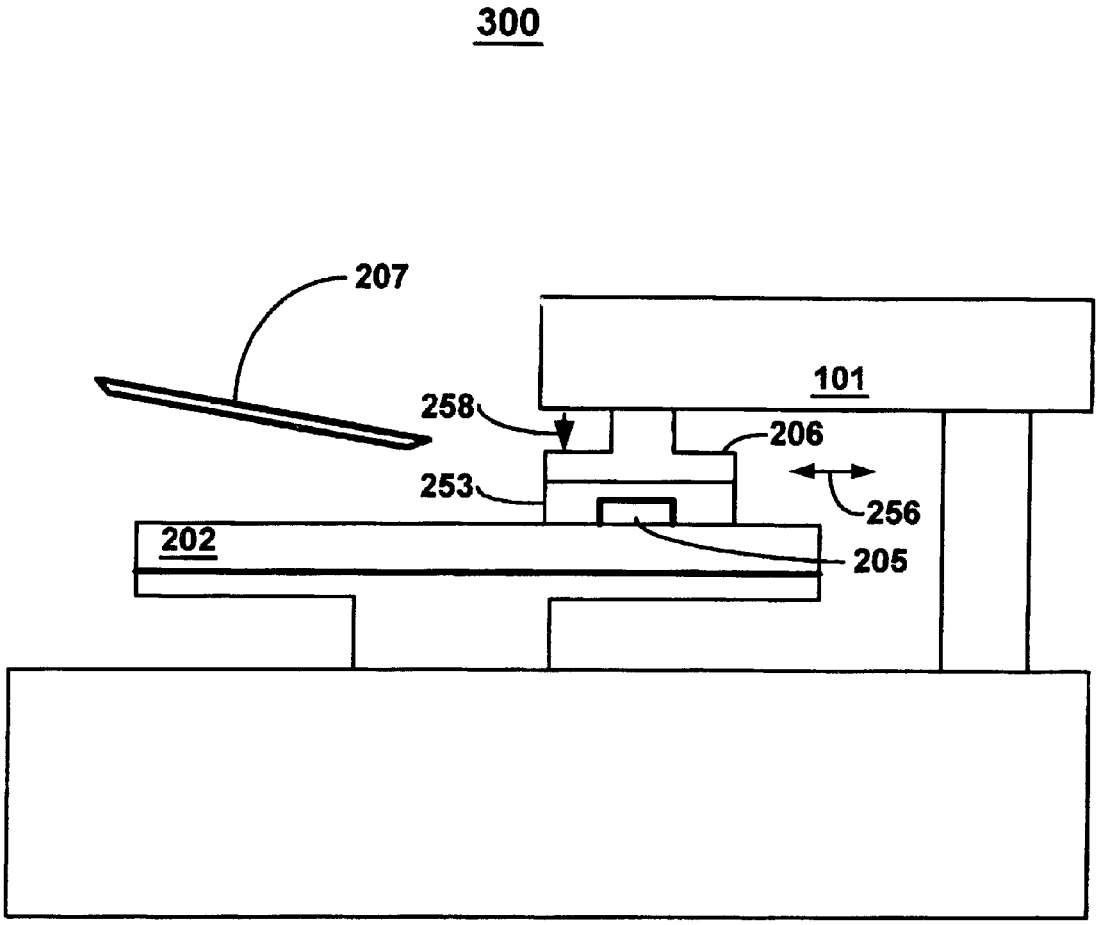
FIG. 3B is a Chemical Mechanical Polish (CMP) machine, shown in an elevation view, with point of polish conditioning features, in accordance with one embodiment of the present invention.

Referring now to FIG. 3A and FIG. 3B, a Chemical Mechanical Polish (CMP) machine 300 with point of polish conditioning features is shown in a plan view and an elevation view, respectively, in accordance with one embodiment of the present invention. CMP machine 300 includes a polish pad 202, a carrier arm 201, a carrier ring 253, and a polish dispensing arm 207. Carrier ring 253, is coupled to carrier arm 201 via carrier 206. Carrier ring 253 has a conditioning feature, shown in detail in a subsequent figure, in one embodiment. CMP machine 300 of the present invention is noticeably streamlined and more efficient with the absence of a separate conditioning assembly, used in the conventional CMP machine as shown in prior art FIGS. 1A and 1B. Thus, by performing the conditioning function at the point of polish, the present invention provides a more effective and efficient CMP machine.

Carrier ring 253 is subject to rotational motion 255 and to translational motion 256, as implemented by carrier 206 and/or carrier arm 201, in one embodiment. However, the present invention is well-suited to using a variety of mechanisms to provide the rotational and/or translational motion for conditioning the pad. By piggybacking the conditioning mechanism on existing mechanisms for rotational and translational motion, the present invention simplifies the CMP machine. This embodiment is referred to as point of polish conditioning because the conditioning occurs proximate to the location where a wafer is actually being polished.

While the present embodiment of FIGS. 3A and 3B utilize carrier ring 253 for point of polishing conditioning of polish pad 202, the present invention is well-suited to using alternative apparatus. For example, the point of polish conditioning device can be an add-on annular ring that fits around a conventional carrier ring. In this latter embodiment, the present invention provides compatibility with conventional carrier rings, thus reducing cost and time-delay for upgrades.

Figure 3C:
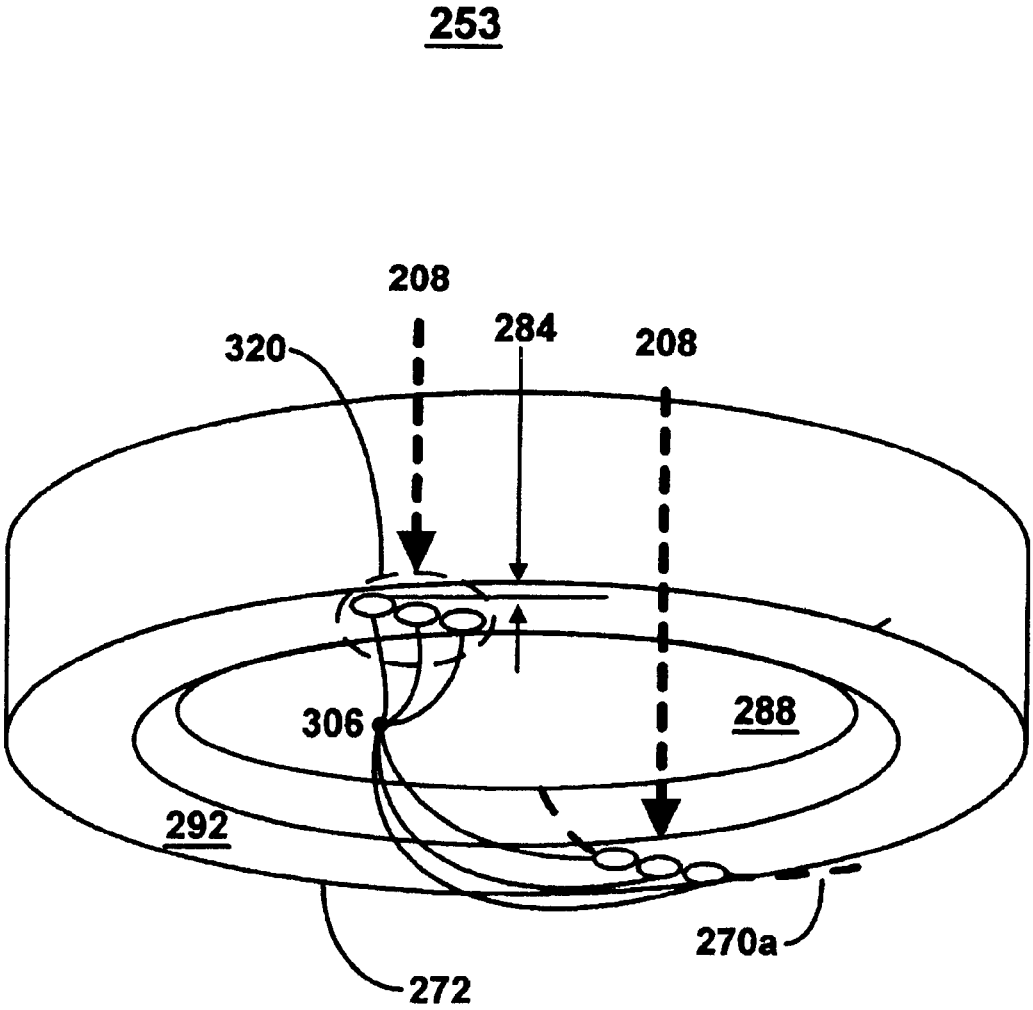
FIG. 3C is a carrier ring, with point of polish conditioning features, for use in a CMP machine, in accordance with one embodiment of the present invention.

Referring now to FIG. 3C, a carrier ring 253 having point of polish conditioning features, for use in a CMP machine, is shown in accordance with one embodiment of the present invention. Carrier ring 253 has a bottom surface 322 that is placed against polish pad 202 during a CMP operation. Carrier ring 253 includes conditioning pins 306.

While the present embodiment shows a total of six (6) conditioning pins 306, in groups 320 of three (3) arranged along a helical, or spiral, path 310*a*, the present invention is well-suited to using any quantity of conditioning pins, grouped in any quantity, and arranged in any pattern. For example, in another embodiment of the present invention, eight (8) groups of three (3) conditioning pins are arranged on a radial path and evenly spaced around the circumference of the carrier ring. In lieu of conditioning pins, the present invention is well-suited to using any type of conditioning device, e.g. conditioning blades, ridges, or the like.

In the present embodiment, conditioning pins 306 are machined from the parent block of material used to fabricate carrier ring 253. However, the present invention is well-suited to using other types of conditioning pins, such as conditioning pins that are a separate parts. In this latter embodiment, conditioning pins 306 may be fixed, e.g. shrunk fit, welded or the like, or conditioning pins 306 may be floating, e.g. spring loaded with a retainer, in carrier ring 253. The present invention is well-suited to incorporating a wide variety of conditioning devices and configurations in carrier ring 253.

Adapter 318 within carrier ring 253 is adapted to hold a wafer for a polishing operation in a CMP machine. Adapter 318 in the present embodiment is a cavity formed within carrier ring 253. However, the present invention is well-suited to using alternative configurations for an adapter to hold a wafer. By proximately locating conditioning pins 306 around adapter 318, point of polish conditioning is accomplished. Carrier ring 253 can be adapted to provide a downward force 258 on conditioning pins 306 to accomplish the conditioning of polish pad 202 of FIG. 3A. Force 258 can be provided by pneumatic means, mechanical spring means, or other similar means. In one embodiment, force 258 applied to conditioning pins is separate and distinct from the downward force applied to a wafer in cavity 318 of carrier ring 253.

Figure 4A:
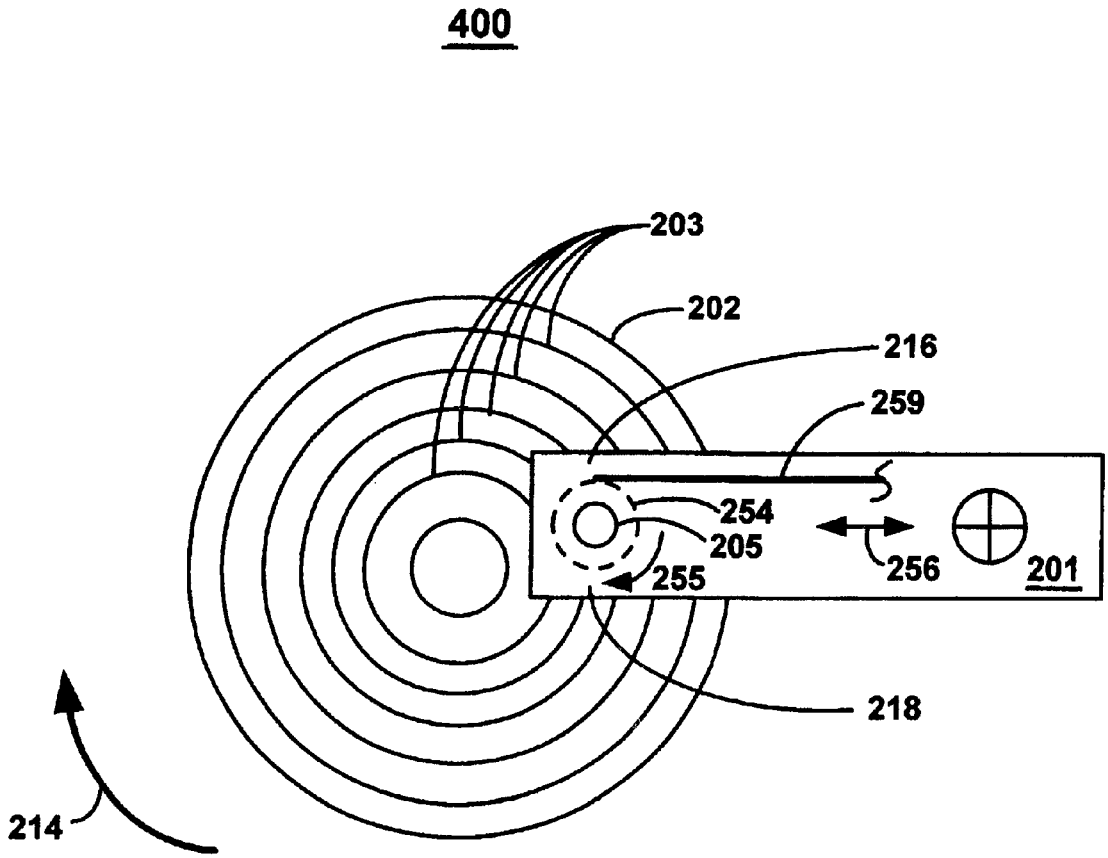
FIG. 4A is a Chemical Mechanical Polish (CMP) machine, shown in a plan view, with both point of polish slurry dispensing features and point of polish conditioning features, in accordance with one embodiment of the present invention.
Figure 4B:
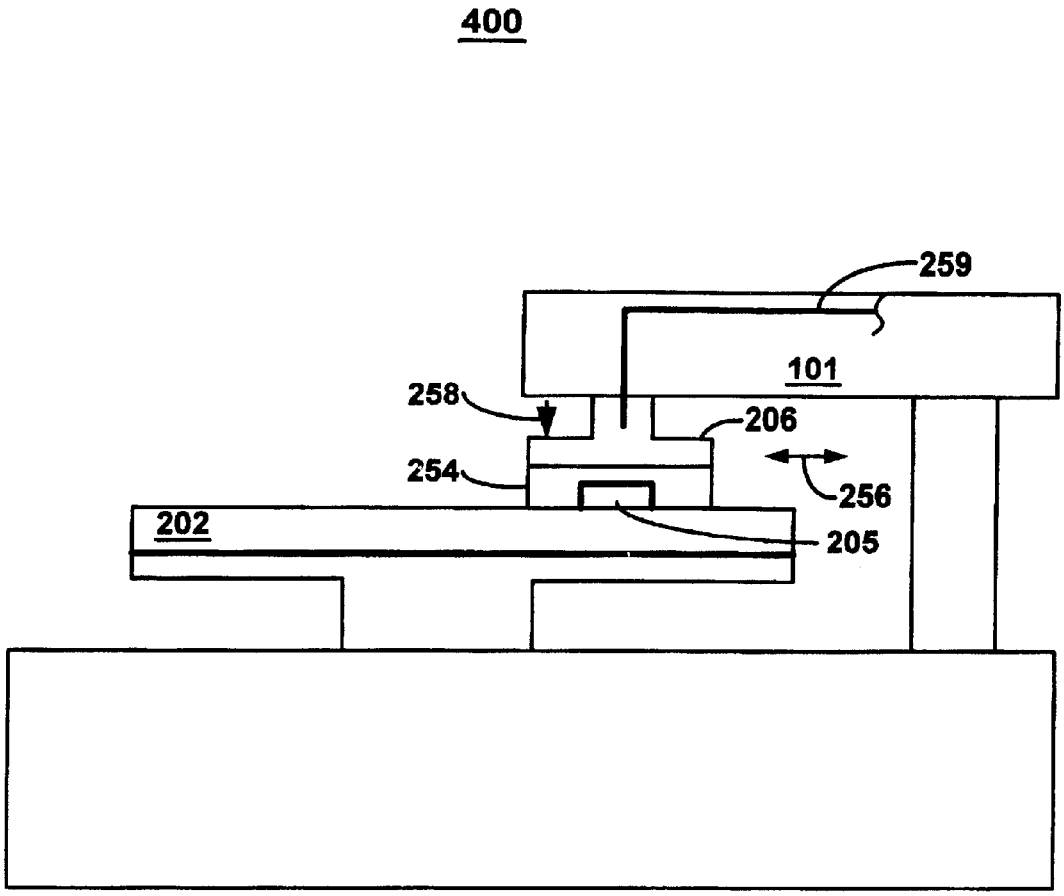
FIG. 4B is a Chemical Mechanical Polish (CMP) machine, shown in an elevation view, with both point of polish slurry dispensing features and point of polish conditioning features, in accordance with one embodiment of the present invention.

Referring now to FIG. 4A and FIG. 4B, a Chemical Mechanical Polish (CMP) machine 400 with both point of polish slurry dispensing features and point of polish conditioning features is shown in a plan view and elevation view, respectively, in accordance with one embodiment of the present invention. CMP machine 400 includes a polish pad 202, a carrier arm 201, and a carrier ring 254. Carrier ring 254, which is coupled to carrier arm 201 via carrier 206, is also coupled to a polish slurry supply line 259, in one embodiment. Carrier ring 254 has a dispensing port for the polish slurry and conditioning pins, shown in detail in a subsequent figure. CMP machine 400 of the present invention is noticeably streamlined and more efficient with the absence of a separate slurry dispense arm and with the absence of a separate conditioning assembly, which were both used in the conventional CMP machine, as shown in prior art FIGS. 1A and 1B. Thus, by incorporating both the slurry dispensing and conditioning function into the carrier ring, the present invention provides a more efficient and more effective CMP machine.

The alternative embodiments provided in FIGS. 2A and 2B for point of polish slurry dispensing are applicable to the present FIGS. 4A and 4B. Likewise, the alternative embodiments provided in FIGS. 3A and 3B for point of polish conditioning are also applicable to the present FIGS. 4A and 4B. The present invention is well-suited to combining the different embodiments provided for point of polish slurry dispensing and the different embodiments provided for point of polish conditioning in a wide variety of ways.

Figure 4C:
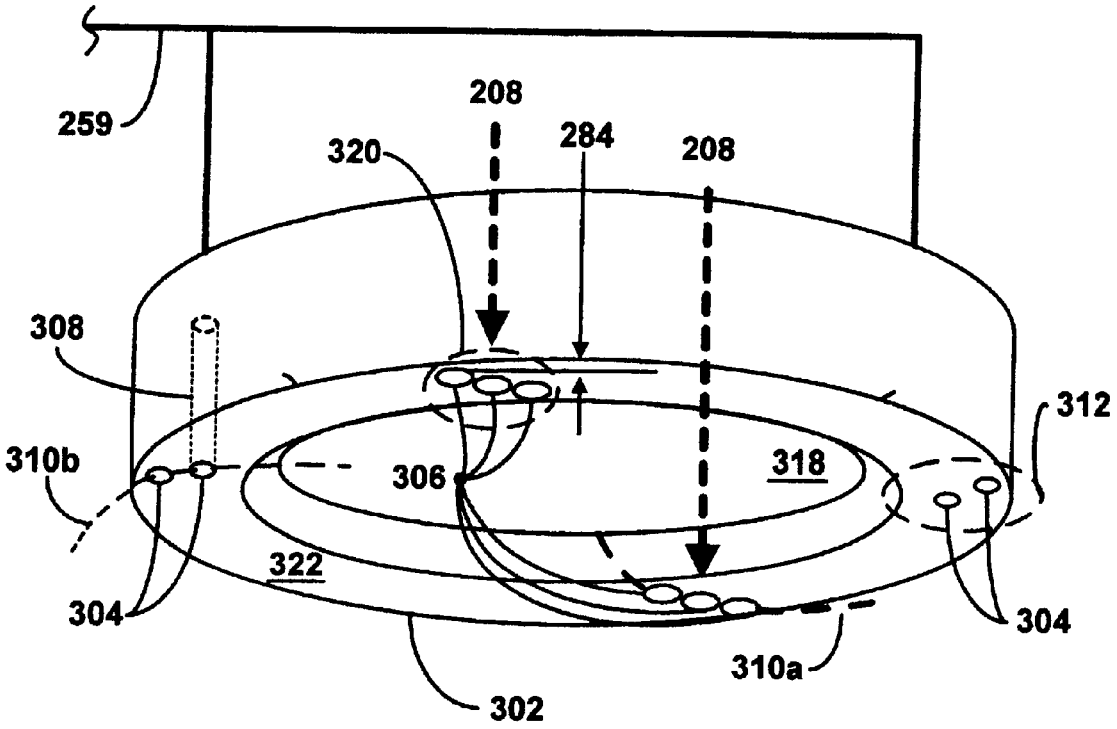
FIG. 4C is a carrier ring, with both point of polish slurry dispensing features and point of polish conditioning features for use in a CMP machine, in accordance with one embodiment of the present invention.

Referring now to FIG. 4C, a carrier ring 254 with both point of polish slurry dispensing features and point of polish conditioning features for use in a CMP machine, is shown in accordance with one embodiment of the present invention. The descriptions provided in FIG. 2C for point of polish slurry dispensing ports 304 are applicable to the present FIGS. 4C. Likewise, the alternative embodiments provided in FIG. 3C for point of polish conditioning are also applicable to the present FIG. 4C.

FIG. 4C intersperses polish slurry dispensing ports 304 and conditioning pins 306 in the present embodiment. This is done to provide more efficient conditioning and more uniform polishing. However, the present invention is well-suited to using a wide variety of combinations of polish slurry dispensing ports 304 and conditioning pins 306. That is, the present invention can use a wide range of relative quantities, relative locations, and relative patterns for the interspersed polish slurry dispensing ports 304 and conditioning pins 306. For example, conditioning pins can be on an inner annular ring while polish slurry dispensing ports can be located on an outer annular ring.

Figure 5:
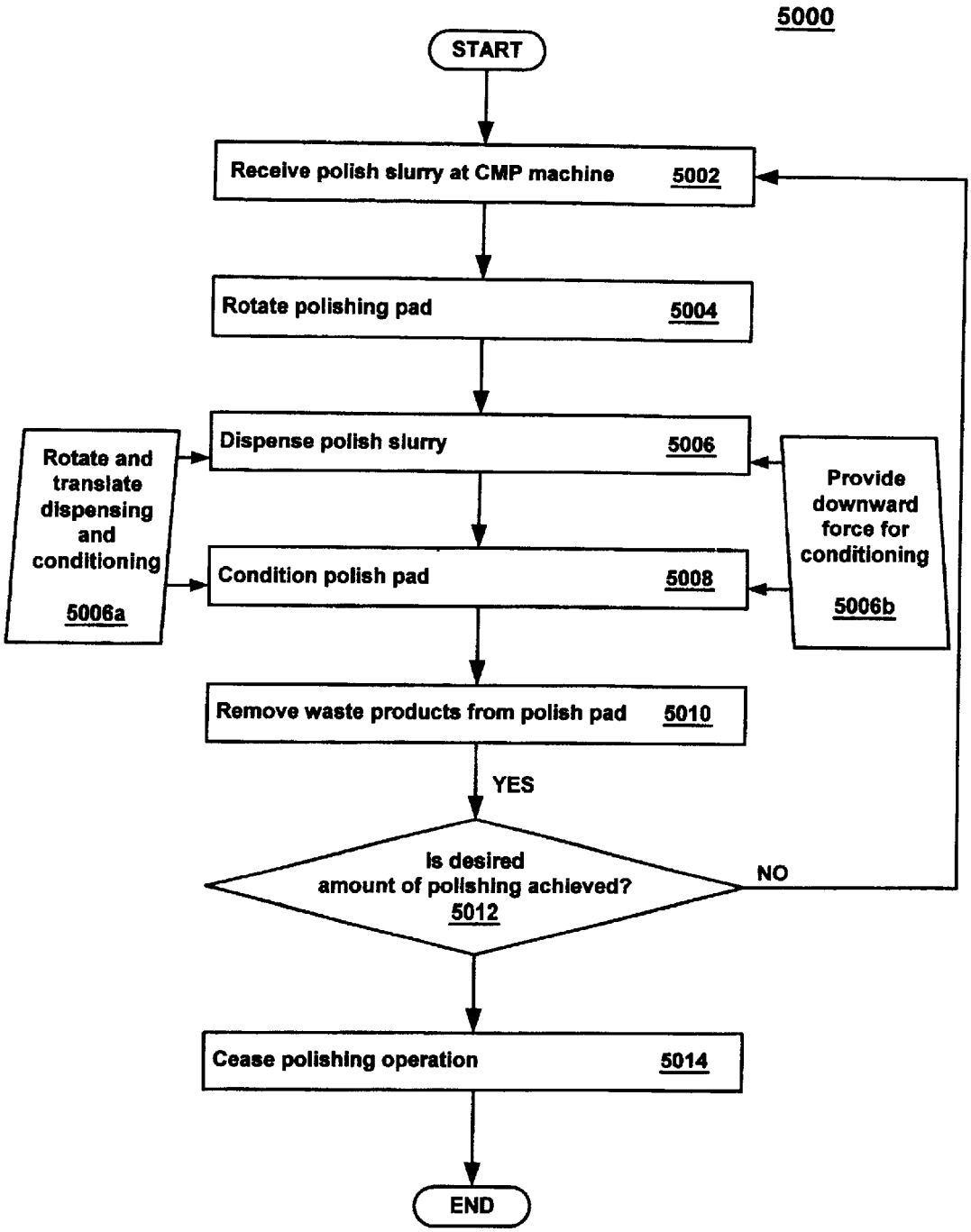
FIG. 5 is a flowchart of the steps performed for point of polish operations in a CMP machine, in accordance with one embodiment of the present invention.

Referring now to FIG. 5, a flowchart 5000 embodiment of the process for point of polish operations in a CMP machine is shown, in accordance with one embodiment of the present invention. By using flowchart 5000 embodiment of the present invention, the effectiveness and efficiency of the CMP machine is enhanced. The present invention also improves the uniformity of polish slurry dispensing and efficient pad conditioning.

Flowchart 5000 begins with step 5002. In step 5002 of the present embodiment, polish slurry is received at the CMP machine. Step 5002 is implemented, in one embodiment, by the apparatus shown in FIG. 2A, 2B, 2C, 4A, 4B, and 4C. Specifically, polish slurry can be supplied to CMP machine 200 or 400 via polish slurry supply line 259, or similar means. Step 5002 is implemented, in an alternative embodiment, by the apparatus shown in FIG. 3A, 3B, and 3C, using a conventional slurry dispensing arm 207. Following step 5002, flowchart 5000 proceeds to step 5004.

In step 5004 of the present embodiment, the polish pad is rotated. Step 5004 is implemented, in one embodiment, by rotating polish pad 202, as shown in FIG. 2A, 2B, 3A, 3B, 4A and 4B. Polish pad 202 is rotated in a clockwise direction 214, in the present embodiment, by means well-known in the art. However, the present invention is well-suited to rotating the polish pad in either direction. The polish pad is rotated so as to provide relative motion against a wafer 205 held in a carrier ring 252, 253, and 254 of FIGS. 2A and 2B, FIGS. 3A and 3B, and FIGS. 4A and 4B, respectively. In the present embodiment, it is desired to have the surface of wafer 205 that is located against polish pad 202 surface to be substantially planarized. This goal is accomplished by this step and by subsequent steps of flowchart 5000. Following step 5004, flowchart 5000 proceeds to step 5006.

In step 5006 of the present embodiment, polish slurry is dispensed. Step 5006 is implemented, in one embodiment, by proximately dispensing polish slurry around wafer 205 being polished. This embodiment of step 5006 is implemented by polish slurry dispensing ports 304 located in carrier rings 252 or 254, as shown in FIGS. 2A, 2B, and 2C and in FIGS. 4A, 4B, and 4C in two embodiments. In the present embodiments, an internal manifold, not shown in FIG. 2C or 4C, can serve as a local reservoir and source for the polish slurry to be dispensed through multiple dispensing ports 304. Thus, the polish slurry is dispensed at the proximate point of polish of the wafer. With an even dispensing of polish slurry around the carrier ring, the polish slurry that is discharged upstream of the wafer acts as a polish medium for the wafer.

Typically, the more dispensing ports in the carrier ring, the more balanced and uniform the polish slurry will be around the wafer. The helical pattern 310*b* used for polish slurry dispensing ports 304 of FIG. 2C and 4C, helps to provide a more uniform dispensing of polishing slurry on polish pad 202 of FIG. 2A and 4A, circumferentially around wafer 205. As shown in FIG. 2A and 4A, polish slurry dispensing ports can be located upstream 216 of wafer 205 as established by direction 214 of polish pad 202. Similarly, polish slurry dispensing ports can be located downstream 218 of wafer 205, or any point in-between, depending on the quantity of polish slurry dispensing ports, and their location at the time of dispensing a given quantity of polish slurry. While step 5006 is implemented with a specific embodiments of carrier rings 252 and 254, the present invention is well-suited to using the alternative apparatus configurations presented for FIGS. 2A, 2B, 2C, 4A, 4B, and 4C. For example, the present invention is well-suited to implementing step 5006 with alternative arrangements and patterns of slurry dispense ports.

The prior art method of dispensing slurry had to correlate the portion of the polish pad receiving the slurry with the location of the polish pad used to polish the wafer. If the polish slurry was not deposited properly in the area where the wafer was being polished, then the quality of the polish operation on the wafer may be inferior. Thus, the present embodiment of the present invention eliminates some of the complicated control and correlation operations used to dispense slurry in the prior art, while providing more uniform slurry dispensing.

In an alternative embodiment, step 5006 is implemented using a conventional polish dispensing arm 207, as shown in FIGS. 3A and 3B. In this embodiment, polish dispensing arm 207 can use conventional, or modified, methods to correlate the location and timing with the position of the wafer in carrier ring 253 for purposes of dispensing polish slurry. Following step 5006, flowchart 5000 proceeds to step 5008.

In step 5008 of the present embodiment, the polish pad is conditioned. Step 5008 is implemented, in one embodiment, by proximately conditioning polish pad around wafer 205 being polished. This embodiment of step 5008 is implemented by conditioning pins 306 in carrier rings 253–254 of FIGS. 3A, 3B, 3C, and FIGS. 4A, 4B, and 4C, respectively, in two embodiments. By using the present invention, polish pad 202 is conditioned proximate to the location of the wafer 205 in the CMP machine 300 and 400.

The present embodiment of the present invention overcomes the limitations of the prior art which uses a separate and complicated conditioning apparatus, e.g. conditioning assembly 120 of FIGS. 1A and 1B. The prior art operation used to condition the polish pad had to correlate the portion of the polish pad being conditioning with the location of the wafer being polished. If the polish pad was not conditioned in the proper area, e.g. where the wafer was being polished, then the quality of the polish operation on the wafer may be inferior. Thus, the present invention eliminates some of the complicated control and correlation operations necessary in the prior art, while providing more consistent and proximately accurate conditioning of the polish pad. Overall, this step saves time, resources, and cost in a CMP machine, while providing efficient conditioning.

While the present embodiment for step 5008 utilizes a specific construction of carrier rings 253 and 254 to implement the conditioning operation of step 5008, the present invention is well-suited to using alternative embodiments, such as those presented for FIGS. 3A, 3B, 3C and FIGS. 4A, 4B, and 4C.

In an alternative embodiment, step 5008 is implemented using a conventional conditioning assembly 220, as shown in FIGS. 3A and 3B. In this embodiment, conventional components in a conventional conditioning assembly 220 can use location and timing methods to correlate the conditioning of the polish pad with the position of the wafer in carrier ring 253.

Inputs 5006*a* and 5006*b* are optional features that can be incorporated into steps 5006 and 5008 to enhance performance. Input 5006*a* causes the rotation and translation of the dispensing and conditioning operations, to effect a uniformity of these operations. As noted in steps 5006 and 5008, the prior art utilized dedicated hardware, e.g. polish slurry dispensing arm 107 and conditioning arm assembly 120 of prior art FIGS. 1A and 1B, to provide motion for slurry dispensing and for conditioning the polish pad. However, this added a significant amount of complexity and cost to the CMP machine and operations.

Beneficially, input 5006*a* of the present invention utilizes, in one embodiment, the existing rotational and translational movements of the carrier ring 252 and/or carrier arm 201 of in CMP machine 200, as shown in FIG. 2A, 2B, in FIGS.

3A, 3B, and in FIGS. 4A and 4B. By rotating carrier ring 252–254, conditioning pins 306 and/or polish slurry dispensing ports 304 sweep circumferentially around wafer 205, located in adapter 318, being polished.

Due to the rotation effect on carrier ring 252, 254 in CMP machine 200 or 400 of FIGS. 2A, 2B, or of FIGS. 4A, 4B, respectively, polish slurry dispensing ports 304 may be located in an upstream area 216 of wafer 205 at one time, and located in a downstream area 218 of wafer 205 at another time. Similarly, due to the rotation effect on carrier ring 253, 254 in CMP machine 300 or 400 of FIGS. 3A, 3B, or of FIGS. 4A, 4B, respectively, conditioning pins 306 may be located at different circumferential positions around wafer at different points in time. Overall, a point of polish slurry dispensing and a point of polish conditioning is accomplished by these different embodiments of the present invention. While the present embodiment for input 5006*a* uses a clockwise rotation and uses translation, the present invention is well-suited to many different combinations of motion implemented by many different devices. For example, in lieu of using a clockwise rotation, the present invention is well-suited to using a counter-clockwise direction or an alternating clockwise/counter-clockwise direction. Similarly, different types of translation across polish pad 202 can be utilized by the present invention.

Input 5006*b* provides a downward force for the conditioning operation. Input 5006*b* is implemented, in one embodiment, using the apparatus of FIGS. 3A, 3B, and of FIGS. 4A and 4B. As shown in these figures, a downward force 258 may be exerted on conditioning pins 306 by a variety of apparatus and methods. In the present embodiment, conditioning pins 306 in carrier ring 252 are subjected to a downward force 258 via a pneumatic source, with its associated controls to manage the applied force. This force can alternatively be applied to the carrier ring 253, 254 directly if conditioning pins 306 are fixed in carrier ring 252, 254.

While the apparatus described for implementing inputs 5006*a* and 5006*b* utilize specific embodiments, the present invention is well-suited to using the alternative embodiments such as those presented for FIGS. 2A–4C. Following step 5008, and inputs 4006*a*–4006*b*, flowchart 5000 proceeds to step 5010.

In step 5010 of the present embodiment, waste products from the polish pad are removed. Step 5010 is implemented, in one embodiment, by the apparatus shown in FIGS. 2A, 2B, and in FIGS. 4A and 4B. Specifically, waste product is removed by the combined effect of polish slurry and of centrifugal force arising from the rotation, e.g. direction 214, of polish pad 202. The polish slurry acts to physically suspend the waste products in polish pad 202. The rotation has the effect of slinging the polish slurry, with its suspended waste, to the outer diameter of polish pad 202, where if falls over the edge, and is disposed. The present embodiment enhances the removal of waste products by dispensing fresh polish slurry at the point of polish in an area immediately downstream 218 of wafer 205, e.g. directly where the polishing byproducts have just been formed. Consequently, the present invention provides very effective and uniform removal of waste products generated from the polishing operation. In an alternative embodiment, waste products can be removed by using the slurry dispense arm 207 embodiment shown in FIGS. 3A and 3B. Following step 5010, flowchart 5000 proceeds to step 5012.

In step 5012 of the present embodiment, an inquiry determines whether the desired amount of polishing is completed. If the desired amount of poising is completed, then flowchart 5000 proceeds to step 5014. However, if the desired amount of polishing is not completed, then flowchart 5000 returns to step 5002. This inquiry provides the necessary logic to start and stop the polishing process, thus ensuring sufficient polishing and planarization of the wafer without overpolishing the wafer. Step 5012 can be implemented using apparatus and methods that are well-known in the art, such as polish stop layers and the like.

Step 5014 arises if the desired amount of polishing, per step 5012, is completed. In step 5014, the polishing operation is ceased. Following step 5014, flowchart 5000 ends.

While flowchart 5000 of the present embodiment shows a specific sequence and quantity of steps, the present invention is suitable to alternative embodiments. For example, not all the steps provided in flowchart 5000 are required for the present invention. For example, input 5006*a* using rotation and translation of dispensing and conditioning may be omitted in some embodiments of the present invention. Furthermore, additional steps may be added to the steps presented in the present embodiment. Likewise, the sequence of the steps can be modified depending upon the application. While flowchart 5000 is shown as a single serial process, it can also be implemented as a continuous or parallel process.

Many of the instructions for the steps, and the data input and output from the steps, of flowchart 5000 can be performed manually, by analog circuit, or by digital circuit. With a digital circuit, steps and data can be stored in memory and implemented by a processor. The memory storage for the present embodiment can either be permanent, such as read only memory (ROM), or temporary memory such as random access memory (RAM). Memory can also be any other type of memory storage, capable of containing program instructions, such as a hard drive, a CD ROM, or flash memory. Furthermore, processor can either be a dedicated controller or an existing system processor. Alternatively, the instructions may be implemented using some form of a state machine.

In view of the embodiments presented herein, the present invention provides a method and apparatus of point of polish slurry dispensing. Hence, the present invention is able to create a very flat surface on a wafer being polished. More specifically, the present invention provides an apparatus and method with reduced complexity for dispensing polish slurry for a CMP polishing operation. The present invention also improves the uniformity of polish slurry dispensing.

Additionally the embodiments presented herein illustrate how the present invention provides a method and apparatus of point of polish conditioning of a polish pad. Hence, the present invention is able to create a very flat surface on a wafer being polished. The present embodiments also illustrate how the present invention provides a method of conditioning a pad that will ensure a flat pad profile. Furthermore, the present invention provides an apparatus and method that improves the effectiveness of the CMP machine. Additionally, the present invention provides more efficient pad conditioning.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A method for conditioning and for dispensing polishing slurry on a polish pad of a Chemical Mechanical Polishing (CMP) machine, said method comprising the steps of:

a) receiving polishing slurry at said CMP machine;

b) rotating said polish pad;

c) dispensing said polishing slurry onto a portion of said polish pad located proximately around a location designated for holding a wafer;

d) conditioning said polish pad proximately around a location designated for holding a wafer; and e) simultaneously performing step c) of dispensing and step d) of conditioning by using interspersed devices on a carrier ring for each step.

2. The method recited in claim 1 wherein said polishing slurry is dispensed onto said polish pad via said carrier ring.

3. The method recited in claim 1 wherein said conditioning step is performed by conditioning devices located proximately around said carrier ring.

4. The method recited in claim 3 wherein said conditioning devices are conditioning pins located on a bottom face of said carrier ring.

5. The method recited in claim 3 further comprising the step of:

providing a downward force on said conditioning devices toward said polish pad.

6. The method recited in claim 4 further comprising the step of:

removing waste products from said polish pad by dispensing said polishing slurry downstream of said location designated for holding said wafer.

7. The method recited in claim 1 further comprising the step of:

rotating said carrier ring about its own axis and radially moving said carrier ring across said polish pad during said dispersing step c).

8. The method recited in claim 1 further comprising the step of:

rotating said carrier ring about its own axis and radially moving said carrier ring across said polish pad during said conditioning step d).

9. A carrier ring for performing a chemical mechanical polishing (CMP) operation, said carrier ring comprising:

an adapter for holding a wafer;

a polish slurry dispensing port formed therein and located proximately around said adapter, said polish slurry dispensing port adapted to provide polish slurry onto a polish pad; and a conditioning device located proximately around said adapter, said conditioning device adapted to condition a polish pad.

10. The carrier ring of claim 9 wherein said conditioning device is a conditioning pin that protrudes from a bottom face of said carrier ring that can interface with said polish pad.

11. The carrier ring of claim 9 wherein said conditioning device is a plurality of conditioning pins distributed around said face of said carrier ring to interface with said polish pad.

12. The carrier ring of claim 11 wherein said multiple conditioning pins are arranged in multiple rows oriented in a radial direction.

13.The carrier ring of claim 12 wherein said multiple conditioning pins are arranged in a spiral path on said face.

14. The carrier ring of claim 12 wherein said multiple slurry dispensing ports are arranged in multiple rows oriented in a radial direction.

15. The carrier ring of claim 14 wherein said multiple conditioning pins are arranged in a spiral path on said face.

16. The carrier ring of claim 9 having a plurality of slurry dispensing ports distributed around a bottom face of said carrier ring to interface with said polish pad.

17. The carrier ring of claim 16 wherein said plurality of dispensing ports are interspersed among a plurality of conditioning pins.

18. A chemical mechanical polishing (CMP) machine for performing a CMP operation on a wafer, said system comprising:

a polish pad having a top surface;

a carrier arm;

a carrier ring coupled to said carrier arm, said carrier ring having an adapter for holding a wafer against said top surface of a polish pad;

a slurry dispensing port located proximately around said adapter for holding said wafer, said slurry dispensing port adapted to dispense polishing slurry on said polish pad; and a conditioning device located proximately around said adapter for holding said wafer, said conditioning device adapted to condition said polish pad.

19. The CMP machine of claim 18 further comprising a plurality of slurry dispensing ports located proximately around said adapter for holding said wafer.

20. The CMP machine of claim 18 wherein said dispensing port is incorporated into said carrier ring.

21. The CMP machine of claim 18 wherein said conditioning device is incorporated into said carrier ring.

22. The CMP machine of claim 18 herein said carrier ring is further adapted to provide a downward force against said polish pad.

* * * * *